United States Patent [19]

Leopoldi et al.

[11] Patent Number: 4,809,141

[45] Date of Patent: Feb. 28, 1989

[54] ILLUMINATED PAPER TRAY

[75] Inventors: Norbert Leopoldi, Chicago; William P. Heinrich, McHenry, both of Ill.

[73] Assignee: The Cloverline, Inc., Chicago, Ill.

[21] Appl. No.: 155,128

[22] Filed: Feb. 11, 1988

[51] Int. Cl.[4] ..... F21V 33/00

[52] U.S. Cl. ..... 362/99; 362/802; 362/208; D19/81; D19/84; D19/86

[58] Field of Search ..... 206/555, 224, 371; 220/60, 284, 330, 331, 332; 362/99, 98, 109, 118, 196, 205, 208, 802

[56] References Cited

U.S. PATENT DOCUMENTS

| | | | |
|---|---|---|---|
| 1,665,132 | 4/1928 | Fisher | 362/802 |
| 2,200,629 | 5/1940 | Louis | 362/99 |
| 2,258,685 | 10/1941 | Mattlatzki | 362/802 |
| 2,658,989 | 11/1953 | Marscatt | 362/802 |
| 3,697,737 | 10/1972 | Leukoff | 362/99 |
| 3,826,910 | 7/1974 | Davis | 362/99 |
| 3,875,396 | 4/1975 | Webb | 362/99 |
| 4,564,887 | 1/1986 | Kier | 362/99 |

FOREIGN PATENT DOCUMENTS

| | | | |
|---|---|---|---|
| 783978 | 1/1935 | France | 362/98 |

*Primary Examiner*—David T. Fidei

*Attorney, Agent, or Firm*—Milton S. Gerstein

[57] ABSTRACT

An illuminated paper tray having a main housing with a well for storing individual sheets of paper. The rear portion of the housing incorporates electrical circuitry for energizing and de-energizing a light bulb, which light bulb illuminates the well of the housing storing the paper via a separating partition of translucent plastic. The illumination of the light bulb is controlled by the insertion or removal of a pen into a through-hole formed in the rear portion of the housing. When the pen is inserted in the housing, for storage, the light bulb is de-energized, whereas upon removal of the pen from the housing for writing, the light bulb is illuminated. The tip of the pen passing through the through-hole and into the interior of the rear portion of the housing controls a pivot plate which has mounted at its freely pivoted end a camming surface which forces a portion of the conducting electrical strips out of contact with each other to thereby break the circuitry between the batteries and the light bulb, while the removal of the pen causes the return of the pivot plate to its normal horizontal position, and the camming surface out of contact with the corresponding portions of the conducting strip of the circuitry, to thereby allow for the normal closed contact state of these conducting strips to thereby allow for the energization of the light bulb.

11 Claims, 3 Drawing Sheets

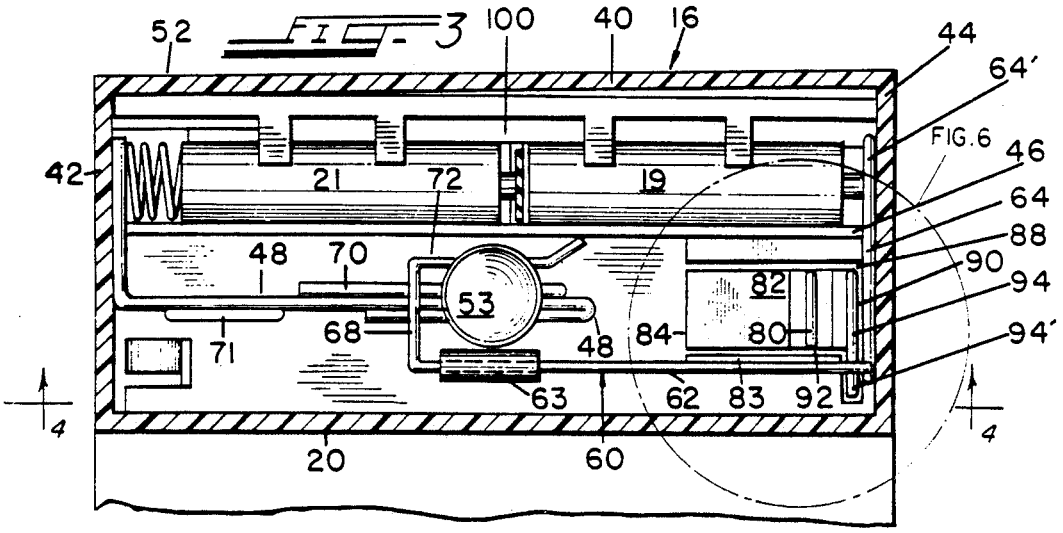
FIG. 3
52
100
40
16
44
64'
FIG. 6
46
64
88
90
94
94'
42
21
72
19
48
70
53
82
68
71
48
84
80
63
62
83
92
4
4
20
60
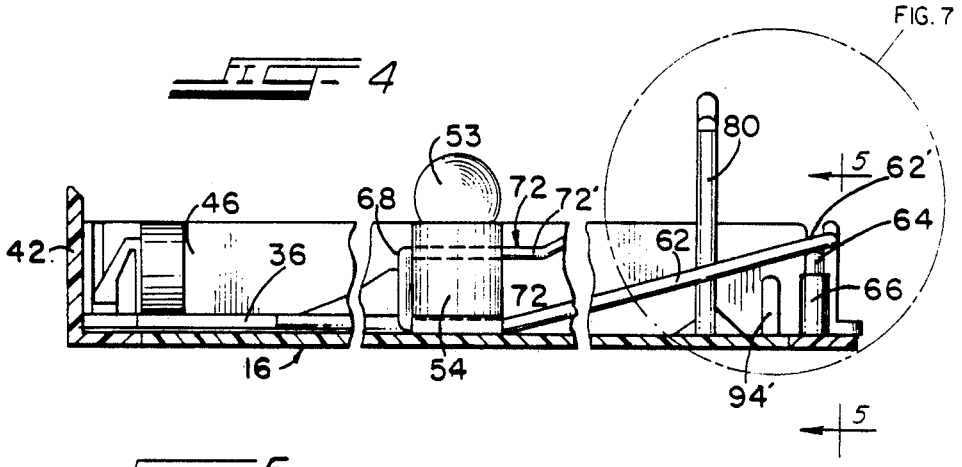
FIG. 4
FIG. 7
53
80
5
62'
46
68
72
72'
64
42
36
62
72
66
16
54
94'
5
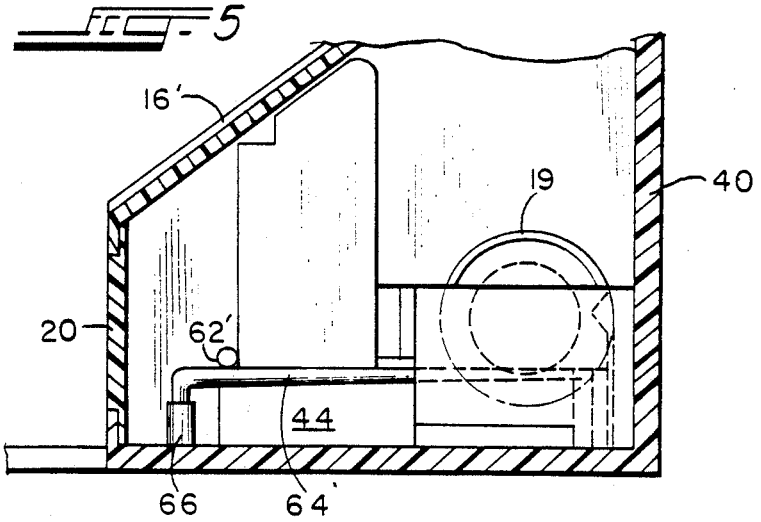
FIG. 5
16'
19
40
20
62'
44
66
64'

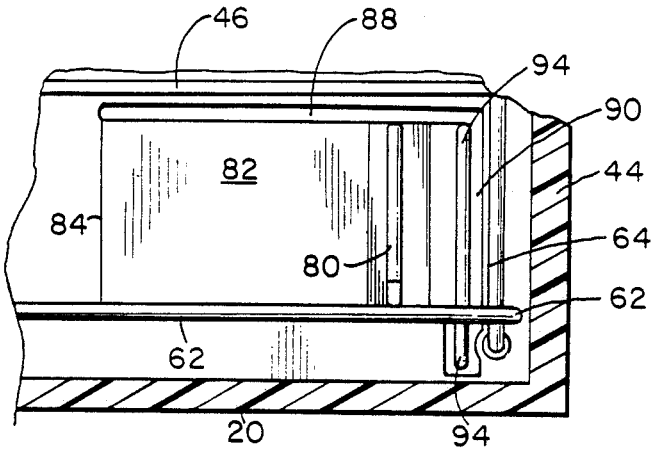
FIG. 6
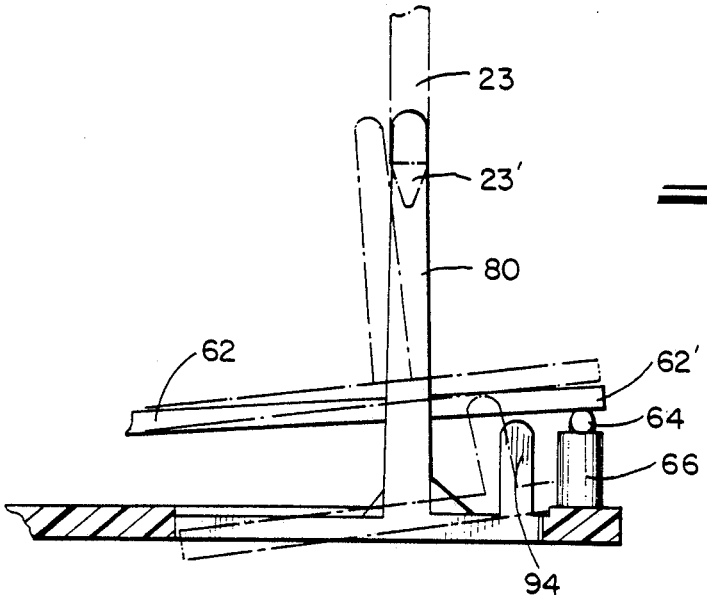
FIG. 7
FIG. 8
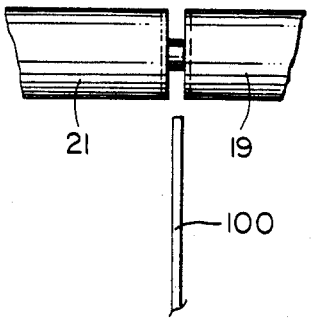

ILLUMINATED PAPER TRAY

BACKGROUND OF THE INVENTION

The present invention is directed to a paper tray for storing and dispensing scratch paper, which paper tray also includes a pen which operates a switch for opening or closing circuitry for illuminating a bulb for illuminating the paper tray, in order to provide light by which one may write on one of the pieces of paper held by the tray. It is known to provide a paper tray with illumination via a bulb that is operated by a switch that is controlled by the pen associated with the tray, removal of the pen causing the switch to close to energize the bulb, while replacing the pen causes the switch to open and the bulb to be de-energized. However such prior art devices are cumbersome and awkward to use, and the switching arrangement thereof for controlling the energization of the bulb less than satisfactory.

SUMMARY OF THE INVENTION

It is, therefore, the primary objective of the present invention to provide a lighted paper tray which has an operatively-associated pen controlling the operation of a switch that opens or closes circuitry to a light bulb, which circuitry is long-lasting and efficient.

It is another objective of the present invention to provide such a lighted paper tray such that the pen operatively associated therewith is insertable into an upper portion of the paper tray housing by its pen-tip first by which the switching circuitry is controlled thereby.

Toward these and other ends, the lighted paper tray of the present invention includes a main housing having a forward portion which stores and dispenses small pieces of paper, such as rectangular-shaped scratch sheets. The housing has a rearward portion mounting therein a pair of batteries, a light bulb, and switching circuitry for controlling the on-off connection between the batteries and the light bulb. A translucent partition divides the forward portion of the housing from the rearward portion, through which the light from the bulb illuminates the front portion and the paper therein. The rearward portion of the housing has a through-opening through which is inserted the tip of the ball-point pen, which tip is used for controlling the state of the switching circuitry via a pivotal pedestal, which lifts a connector contact of the switching circuitry when the pen is inserted in the through-opening, and allows for the normal closing thereof when the pen is removed.

BRIEF DESCRIPTION OF THE DRAWING

The invention will be more readily understood with reference to the accompanying drawing, wherein:

FIG. 3 is a cross-sectional view taken along line 3—3 of FIG. 1;

FIG. 4 is a cross-sectional view taken along line 4—4 of FIG. 3;

FIG. 5 is a cross-sectional view taken along line 5—5 of FIG. 1;

FIG. 6 is an exploded view of the encircled portion of FIG. 3;

FIG. 7 is an exploded view of the encircled portion of FIG. 4; and

FIG. 8 is a detail view showing the connection between the two batteries powering the light bulb.

DETAILED DESCRIPTION OF THE INVENTION

Figure 1:
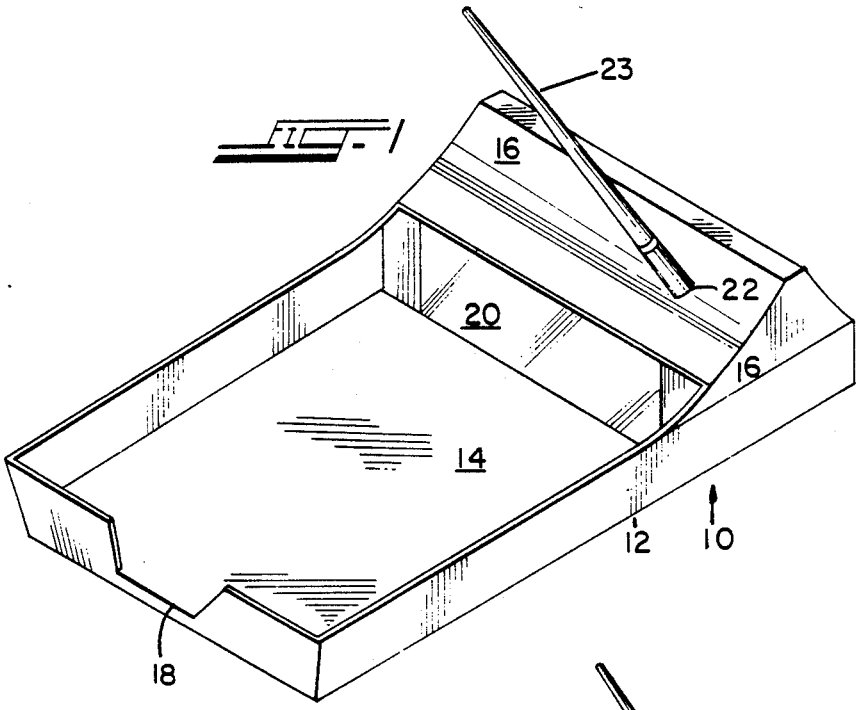
FIG. 1 is an isometric view of the illuminated paper tray of the invention.
Figure 2:
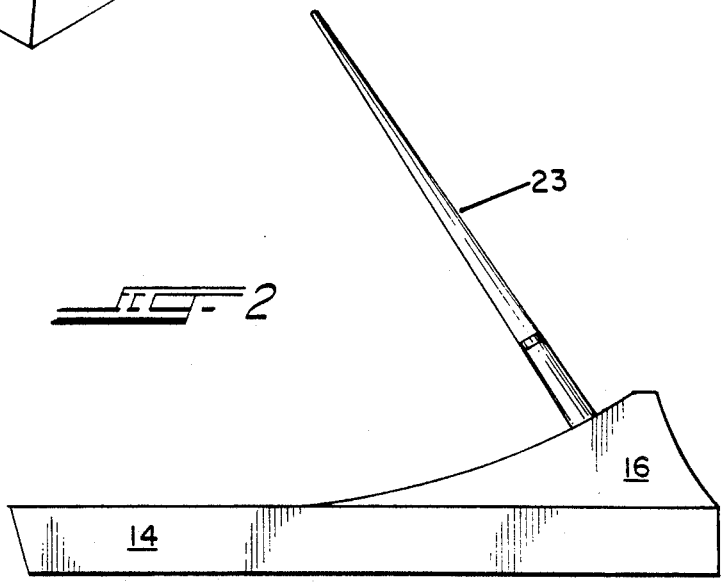
FIG. 2 is a side elevation view thereof.

Referring now to the drawings in greater detail, the illuminated paper tray is indicated generally by reference numeral 10 in FIG. 1. The tray includes a main housing 12 defined by a forward or front portion 14 and a back or rearward portion 16. The forward portion defines a well in which is stored a stack of rectangular-shaped sheets of scratch paper. A forward notch 18 in the front portion allows for easy removal of a topmost sheet of paper. A translucent plastic element 20 divides the rearward and forward portions of the housing, the element 20 being mounted by the rear portion of the housing by conventional means, such as by end tabs. The rear portion of the housing defines a hollow interior as shown in FIG. 5 in which is housed the illuminating circuitry of the present invention. The rearward portion 16 of the housing has a rearwardly-sloped, concave-shaped upper surface 16', in which is formed a through-opening 22 which receives the tip-end of a pen 23. This tip-end of the ball-point pen is a truncated-cone shape, so as to allow for the insertion thereof into the opening 22 a certain distance only, which distance is sufficient enough to allow for the tip-end of the ball point pen to act upon a portion of the switching circuitry described below in greater detail.

Referring to FIGS. 3–7, the switching circuitry which is controlled in response to the insertion and retraction of the ballpoint pen 23 is mounted upon a plastic mounting plate 36, which plate 36 closes off the bottom rear portion 16 of the housing, such plate allowing for the easy removal of the switching and illuminating circuitry for replacement of parts, such as the light bulb, etc, as well as allowing for easy and facile manufacture and mass production. The plate 36 is removably attached via a pivotal tab, which is conventional and well-known, removal being easily accomplished by simply pivoting the tab to a release position. The plate 36 is provided with upwardly projecting partition walls for forming compartments which mount the illuminating and switching circuitry. Partitions 40, 42, 44, and wall 46 define therebetween the battery compartment for two AA size batteries. The wall 46 is shortened such that its two end edges do not contact the end walls 42, 44, to leave gaps through which project conductors 48, 64 forming part of the illuminating and switching circuitry. Metal spring 52 contacts the negative terminal of the first battery, with the coils thereof being transformed into the conductor 48, so that the conductor 48 is integral with and forms an extension of the spring 52, the conductor 48 having an end 48, in electrical contact with the bottom metal contact of the conventioanl bulb 53, received in an interiorly-threaded plastic housing or sleeve 54. The end 48' is preferably bent back to form a loop to ensure good contact with the bottom metal contact of the bulb. The plastic sleeve 54 has a pair of diametrically-opposed bottom cutouts to allow for the passage of the looped end 48' therethrough, with the bottom metal contact of the bulb thereby resting upon the looped end 48' when the bulb it is screwed into the plastic sleeve 54. The spring 52, conductor 48 and looped end portion 48' constitute the first half of the electrical conducting circuitry of the invention, with the end 48′ being in contact with the lower electrical contact tip of the convention light bulb 53. The other half of the electrical circuitry, which constitutes, in combination with the tie-end of the pen, the on-off switching portion thereof. This second portion includes an electrical conductor 60 seen in FIG. 3 which includes a first linear portion 62 that rises at an angle alpha with respect to the horizontal, the end thereof 62′ being held in a raised position via another metal conductor 64 which is stationary and fixed upon a vertical partition or wall 66, the conductor 64 being suitably imbedded in the upper edge surface of the partition 66. The end 62′, in its normal biased state, due to the normal springiness of the metal conductor itself, causes the electrical circuitry to be in its closed electrical conducting state in which the light bulb 53 is illuminated, since the power from the batteries is allowed to energize the bulb. This second half of the electrical circuitry also includes integrally formed right angle portion conductor 68, which also in the preferred embodiment extends upwardly at an angle as best seen in FIG. 4, such incline being from the front towards the rear, in order to space the metal conductor 68 from the adjoining portion of the looped end portion 48. The elevation of the conductor portion 68 is achieved via a spacing ramp 70 which ensures the separation from contact with the looped end portion 48′. The last terminal part of the second portion of the electrical circuitry is the conductor indicated by reference number 72 in FIGS. 3 and 4, which includes a linear portion 72′ and a bent portion 72″, the bent portion 72′ being urged against the front portion of the partition wall 46 by the natural springiness thereof. The linear portion 72′ passes through a cutout portion formed in the plastic insulating sleeve 54 of the socket for the light bulb, such cut-out potion thereby exposing the threaded metallic casing of the convention light bulb 53, whereby a completed circuit is formed between the tip electrode of the light bulb 53 and its threaded metal casing, to thereby power the light bulb in a conventional manner via a closed path. The cut-out of the insulating socket preferably extends from the bottommost portion of the socket upwardly for a distance of approximately two-thirds of the height of the plastic sleeve of the socket, and extends angularly about the circumference of the plastic sleeve of the socket an angular distance of approximately 60 degrees. It is noted that the linear conductor 64 has a rearward most end 64′ in contact with the positive terminal 17 of the battery 19, to complete the circuit.

In order to de-energize a light bulb 53 when the pen 23 is inserted into the opening 22, as well as to cause the energization of the light bulb 53 when the pen 23 is removed, there is provided a vertically upstanding pivot post 80 having a height in the preferred embodiment generally greater than the height of the uppermost portion of the bulb 53 extending upwardly from the socket 54. This pivot post 80 is provided with a canted or sloped upper edge surface, which slopes downwardly from rear to front. The lower base of this pivot post is integrally connected to a pivot plate 82 which has an axis of pivot provided via a connected end edge surface 84, which is joined to the remainder of the mounting plate 16, as clearly shown in FIG. 3. To provide for such pivoting action about the end edge 84, the pivot plate 82 is disconnected from remaining peripheral adjoining surfaces of the plate 16, to thereby define gaps 88 on the rearward side thereof, 90 on the lateral side thereof, and 92 on the forward side thereof. Thus, it may be seen that the slightest force applied to the upper canted surface of the pivot post 80 will cause the pivot plate 82 to also pivot about its pivot axis defined by the lateral edge 84 thereof. It is the conically shaped tip of the edge 84 thereof. It is the conically shaped tip of the pen 23 that provides the force necessary on the upper inclined surface of the pivot post 80 to bring about the movements necessary to cause the pivotal movement of the pivot plate 82 about its lateral edge surface 84. At the lateral end of the pivot plate 82, there is provided an upstanding vertical camming wall 94 which projects slightly forwardly of the forward edge surface of the pivot plate 82, which projecting surface indicated by reference numeral 94′ lies directly beneath a corresponding portion of the upwardly inclined conductor 62, as best seen in FIG. 4. This camming wall is provided with a substantially convex upper surface, which upon the upward movement thereof, brought about by the pivotal movement of the pivot plate 82 via the conical tip of the pen camming against the upper inclined surface of the pivot post 80, will strike against the portion of the conductor 62 positioned directly thereabove, to thereby lift the end 62′ thereof out of contact with the conductor strip 64, to thereby break the circuitry energizing the light bulb 53, as long as the pen 23 is inserted in the manner shown in FIG. 1. When the pen 23 is removed, the natural springiness of the conductor 62 will cause the end 62′ thereof to return to its normal contact against the conductor strip 64, to thereby reclose the circuitry to thereby energize the light bulb 53. FIG. 7 shows the manner by which the conical shaped tip 23′ of the pen 23 wedges the pivot post 80 in a direction toward the socket 54, thereby concomitantly causing the upward pivotal movement of the pivot plate 82 therewith, simultaneously causing the upward movement of the camming wall 94 to thereby lift the end 62′ of the conductor 62 out of contact with the conductor strip 64 to achieve that which was described above.

The battery compartment is also provided with a lower or bottom slot through which projects a plastic strip 100 seen in FIGS. 3 and 8, which slot is located directly between the two batteries 19 and 21, so that upon the inserton of the strip 100 via the lower slot, a portion of the strip will break the connection between the two batteries to thereby make the circuitry inoperative for manufacturing and shipping purposes, which strip 100 is to removed by the consumer when he wishes to initially use the device 10. To further aid in the structural integrity of the second portion of the circuitry, a plastic insulating sleeve 63 is provided for the end conductor portion 62 adjacent to the conductor 68, which sleeve 63 causes additional springiness to the conductor 62 to ensure the normally-closed contact of the end 62′ thereof with the conductor strip 64. A plastic insulating stop member 71 shown in FIG. 3 also prevents the forward movement of the conductor 48, which stop member 71 is a generally elongated member substantially colinear with the lower transverse slots formed in the bottom of the plastic threaded socket or sleeve 54, through which slots projects the bent back portion 48, whereby the conductor 48 extends generally laterally between the stop member 71 and the upwardly projecting camming surface 70. This arrangement also allows for easy installation and removal of the conductor 48 and integrally connected spring, for ease of manufacture and replacement of parts, by simply sliding it along the upper surface of the mounting plate 16.

While the specific embodiment of the invention has been shown and described, it is to be understood that numerous changes and modifications may be made therein without departing from the scope and spirit of the invention as set forth in the appended claims.

What we claim is:

1. A lighted paper tray comprising:

a main housing having a forward well portion thereof in which may be placed individual sheets of paper, said main housing having a rear portion defining a pen-receiving opening, said rear portion and said well portion being separated;

illuminating means mounted in said rear portion of said main housing for illuminating said well portion;

a pen having a tip thereof for insertion into said pen-receiving opening, said tip of said pen having at least a portion thereof that is substantially frusto-conical in shape such that said portion of said tip projects interiorly into said rear portion of said main housing;

said illuminating means comprising electrical circuitry, a light means, and switch means operatively associated with said tip of said pen for alternatively closing and opening said electrical circuitry in response to the removal and insertion of said pen;

said switch means comprising an upstanding pivot post substantially vertically oriented in said rear portion of said main housing, a pivot plate having at least a portion of at least one edge surface thereof connected to a respective surface portion of said rear portion of said main housing for pivotal movement about a horizontal axis, said pivot post being joined to said pivot plate at a portion of said pivot plate spaced from the pivot axis thereof, so that a force applied to said pivot post will cause said pivot plate to pivot about said pivot axis;

said pivot post having an upper surface portion thereof against which said tip of said pen contacts when inserted in said rear portion of said main housing to cause the pivotal movement of said pivot plate about said pivot axis to thereby de-energize said light means.

2. The paper tray according to claim 1, wherein said electrical circuitry comprises at least one battery, a first conducting strip portion, and a second conducting strip portion;

said first conducting strip portion being in electrical contact with one terminal of said at least one battery and a terminal of said lighting means;

said second conducting strip portion being in electrical contact with another terminal of said battery means and another terminal of said lighting means;

said switch means being operatively associated with said second conducting strip portion to cause the respective closing and opening thereof to thereby illuminate and de-energize said lighting means respectively.

3. The paper tray according to claim 2, wherein said second conducting strip portion comprises a first conducting strip having a first end in contact with said another terminal, and a second end; and a second conducting strip having a first portion thereof in electrical contact with said another terminal of said lighting means, and a second end selectively positionable against said second end of said first conducting strip;

said switch means alternatively moving said second end of said second conducting strip into and out of contact with said second end of said first conducting strip.

4. The paper tray according to claim 3, wherein said first portion of said second conducting strip passes through a cut-out formed in the insulating socket for said lighting means to thereby establish electrical connection therebetween.

5. The paper tray according to claim 3, wherein said switch means further comprises a camming surface integrally formed with said pivot plate, said camming surface having at least a portion thereof directly adjacent to said second end of said second conducting strip, so that upon movement of said pivot plate about said pivot axis, said camming surface abuts up against said second end of said second conducting strip to thereby move said second end thereof out of contact with said second end of said first conducting strip to thereby de-energize said lighting means.

6. The paper tray according to claim 5, wherein said pivot plate is joined to said surface portion of said rear portion of said main housing along only one lateral edge thereof constituting said pivot axis, the other edge surfaces of said pivot plate being spaced from said rear portion of said main housing;

said camming surface having a length taken in the direction from rear toward front greater than the width of said pivot plate also taken in the direction from rear towards front, to thus define a protruding portion of said camming surface which directly abuts against said second end of said second conducting strip when said pivot plate is pivoted upwardly about said pivot axis when said pen is inserted into said main housing and the tip thereof abuts against said pivot post means to cause said pivotal movement of said pivot plate.

7. The paper tray according to claim 6, wherein said main housing further comprises a translucent plastic sheet between said well portion and said rear portion to thereby define the separation therebetween;

said illuminating means being spaced rearwardly of said plastic sheet to thereby illuminate said well portion through said translucent plastic sheet.

8. The paper tray according to claim 1, wherein said rear portion comprises a rearwardly and upwardly sloping surface in which is formed a through-hole for the reception therethrough of the tip-end of said pen, said through-hole having a depth such that the endmost portion of said tip of said pen projects therebeyond for contact against a portion of said electrical circuitry; switch means being operatively associated with said tip of said pen for alternatively energizing and deenergizing said lighting means of said illuminating means.

9. The paper tray according to claim 8, wherein said tip of said pen is substantially frustro-conical in shape to provide a wedging action against said switch means of said electrical circuitry.

10. The paper tray according to claim 9, wherein said switch means comprises a pivotal plate, and an upstanding post therefrom;

said switch means further comprising a circuit-breaking element affixedly attached to said plate means for breaking the contact of said electrical circuitry with said lighting means upon the insertion of said pen into said through opening.

11. The paper tray according to claim 1, wherein said rear portion of said housing comprises an individual, removable mounting plate mounting said illimunating means for allowing access thereto for replacement of parts, said rear portion of said main housing having a cutout formed therein for receiving said mounting plate, and means for removably securing said mounting plate in said cutout.

* * * * *